US007987975B1

(12) United States Patent
Lee

(10) Patent No.: US 7,987,975 B1
(45) Date of Patent: Aug. 2, 2011

(54) STANDABLE WRENCH RACK

(76) Inventor: Hong-Jen Lee, Taichung (TW)

( * ) Notice: Subject to any disclaimer, the term of this patent is extended or adjusted under 35 U.S.C. 154(b) by 0 days.

(21) Appl. No.: 12/904,122

(22) Filed: Oct. 13, 2010

(51) Int. Cl.
*B65D 85/28* (2006.01)
*A47F 7/00* (2006.01)

(52) U.S. Cl. ..... 206/45.23; 211/70.6; 206/376

(58) Field of Classification Search ..... 206/372, 206/373, 374, 375, 376, 377, 45.2, 45.23, 206/45.24; 211/70.6
See application file for complete search history.

(56) References Cited

U.S. PATENT DOCUMENTS

| | | | | |
|---|---|---|---|---|
| 5,505,316 | A * | 4/1996 | Lee | 211/70.6 |
| 6,401,923 | B1 * | 6/2002 | Huang | 206/376 |
| 6,464,840 | B1 * | 10/2002 | McCann | 206/349 |
| 2008/0060960 | A1 * | 3/2008 | Hu | 206/376 |

* cited by examiner

*Primary Examiner* — Jacob K Ackun, Jr.

(57) ABSTRACT

The present invention discloses a wrench rack comprising a main frame, two recess bases, a linkage member and a cover plate. Two recess bases are set on the main frame, and each recess base has a plurality of recesses defined on its front for handle portions of wrenches to be engaged. The linkage member links with the main frame and the cover plate respectively. When the cover plate covers up the front of the main frame, the wrenches are limited. When the cover plate is flipped to the rear of the main frame, the cover plate is able to sustain the main frame along with the stand of the main frame. Therefore, the stability of the holder to place wrenches can be improved and so can the flexibility for users.

7 Claims, 11 Drawing Sheets

STANDABLE WRENCH RACK

FIELD OF THE INVENTION

The present invention relates to a wrench rack, particularly to a standable wrench rack which allows a plurality of wrenches to be steadily held and enhances its flexibility for users.

BACKGROUND OF THE INVENTION

According to the prior art of a wrench holder disclosed in U.S. Pat. No. 5,346,063, it comprises a flat main frame which has two pieces of plates protruded from its both sides on the front. There is a plurality of recesses symmetrically defined on the two plates for wrenches to be placed. Each opening of the recess has a hook, and the wrenches are prevented falling from the recesses by the hooks. There are certain disadvantages from the prior art:

1. Wrenches are not able to be firmly held in the recesses with only two plates and simple-designed recesses on the main frame.

2. The holder can only be laid down due to the flat design of the main frame. Because the wrench holder is not standable, it causes inconvenient for users to choose proper wrenches.

The present invention will become more obvious from the following description when taken in connection with the accompanying drawings which show, for purposes of illustration only, a preferred embodiment in accordance with the present invention.

SUMMARY OF THE INVENTION

The object of the present invention is to provide a more flexible wrench rack for users. It comprises a main frame, two recess bases, a linkage member and a cover plate. The main frame includes a hook plate, a stand, a back plate, a sunken anchor portion, a pivot and two positioning holes. Each recess base is set on the main frame and has a plurality of recesses defined on its front for handle portions of wrenches to be engaged. The linkage member links with the main frame and the cover plate respectively, and it has a protruded plate and a flange which lodges in the positioning hole. The cover plate includes a buckle, a long groove and an anchor plate. The buckle allows the hook of the hook plate to clasp. When the cover plate covers up the front of the main frame, the bottom portion of the back plate props up the linkage member for the flange to lodge in the first positioning hole. When the buckle of the cover plate is released from the hook of the hook plate, the cover plate is capable of revolving against the main frame. When the flange of the linkage member is released from the first positioning hole, the cover plate is capable of revolving against the main frame along with the linkage member. When the cover plate is flipped to the rear of the main frame, the flange of the linkage member is lodged into the second positioning hole. Inasmuch as one side of the anchor plate of the cover plate presses against the anchor portion of the main frame and the other side bears pressure from the protruded plate of the linkage member, the cover plate is able to sustain the main frame along with the stand.

DETAILED DESCRIPTION OF THE PREFERRED EMBODIMENT

Figure 1:
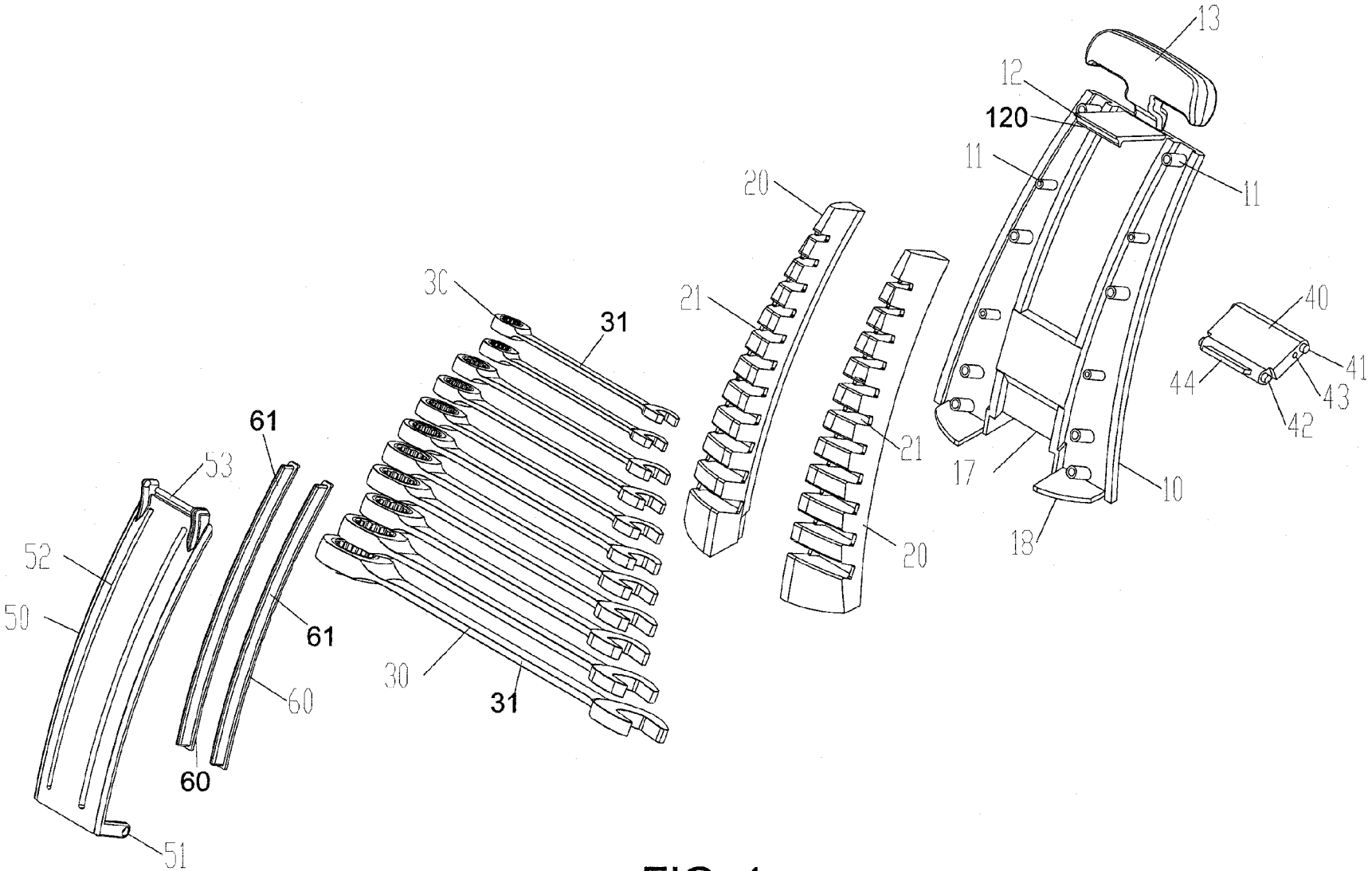
FIG. 1 is an exploded perspective front view of the wrench rack in accordance with the present invention.
Figure 2:
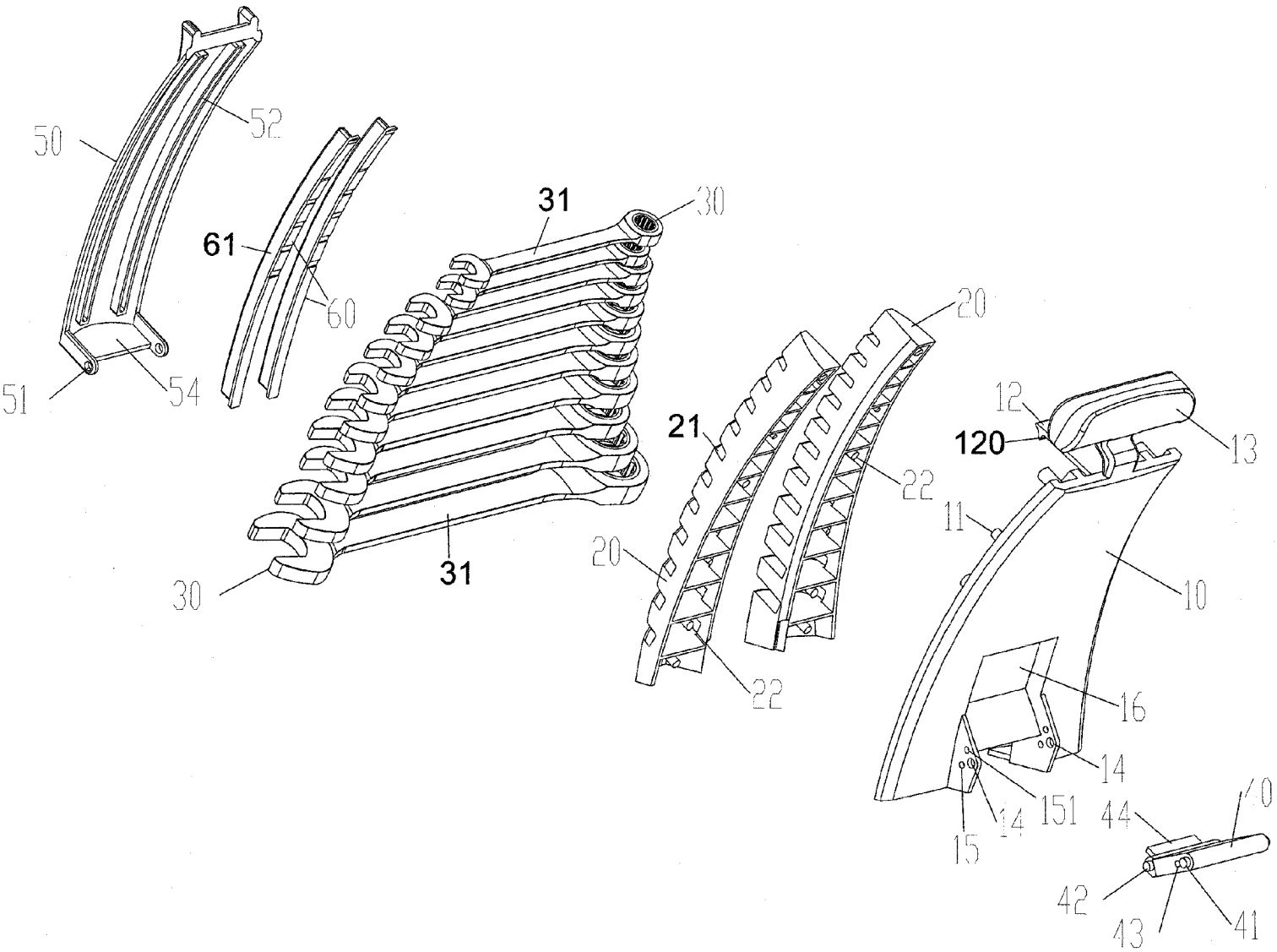
FIG. 2 is an exploded perspective rear view of the wrench rack in accordance with the present invention.
Figure 3:
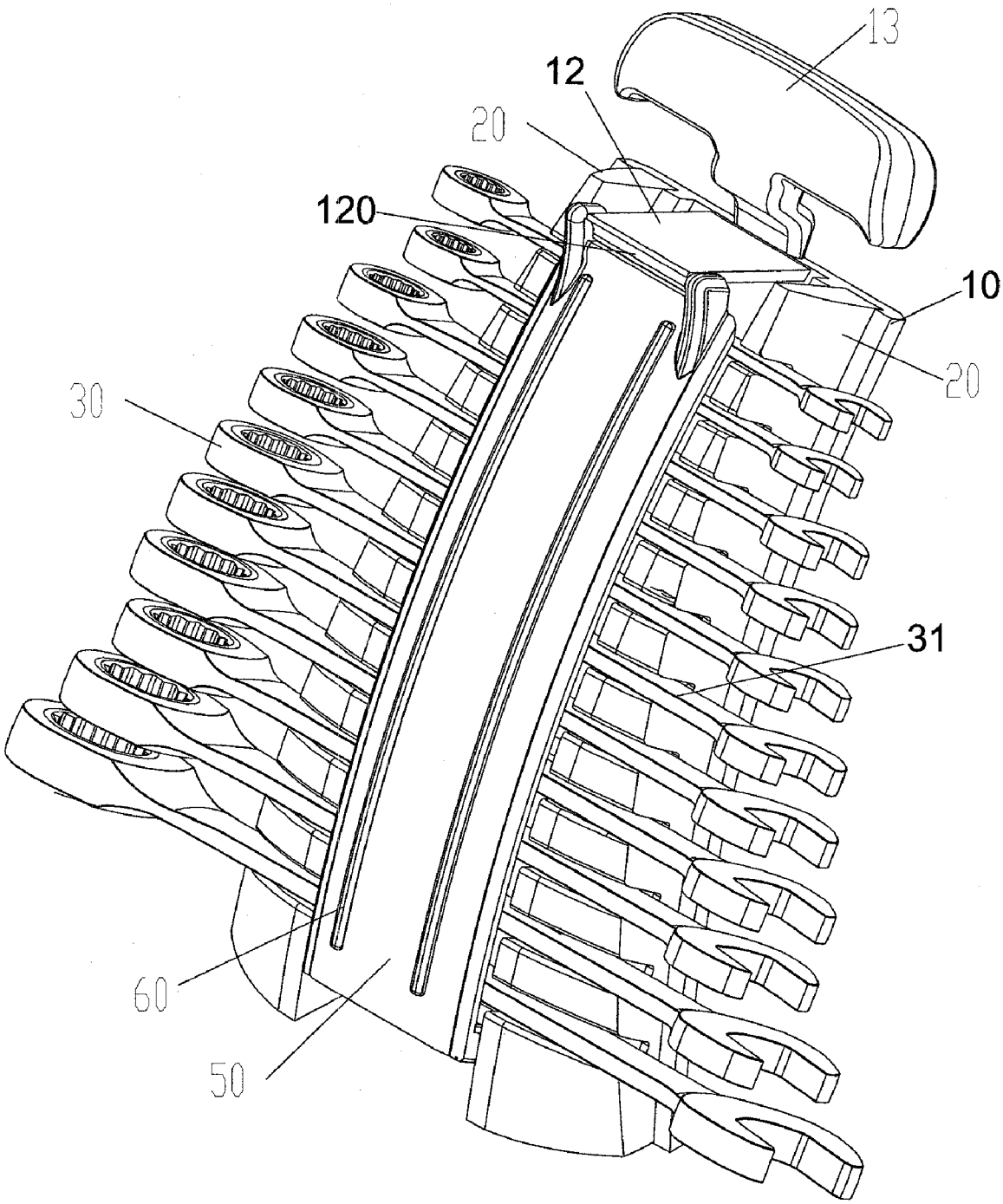
FIG. 3 is an assembled perspective front view of the wrench rack in accordance with the present invention.
Figure 4:
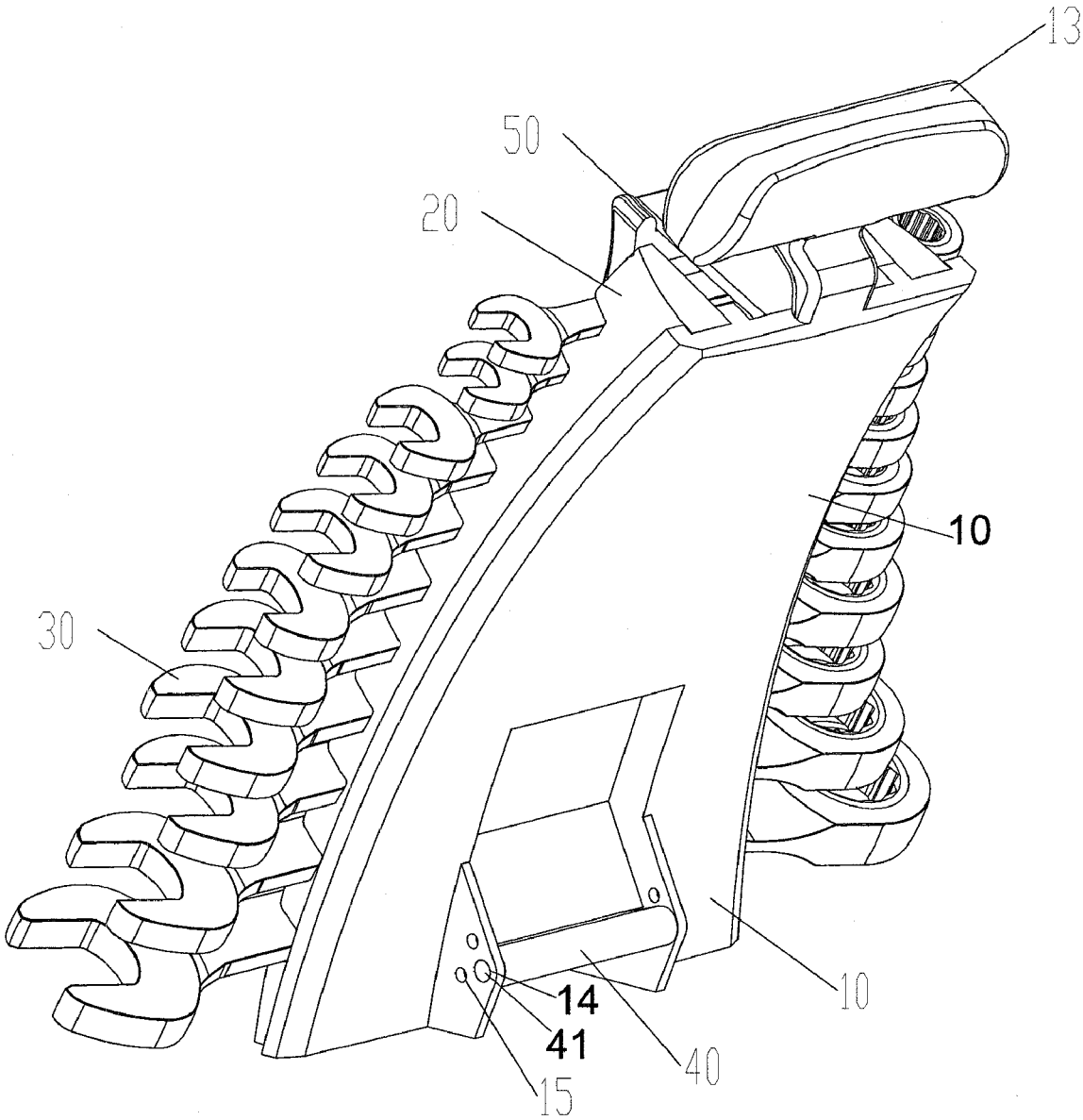
FIG. 4 is an assembled perspective rear view of the wrench rack in accordance with the present invention.
Figure 5:
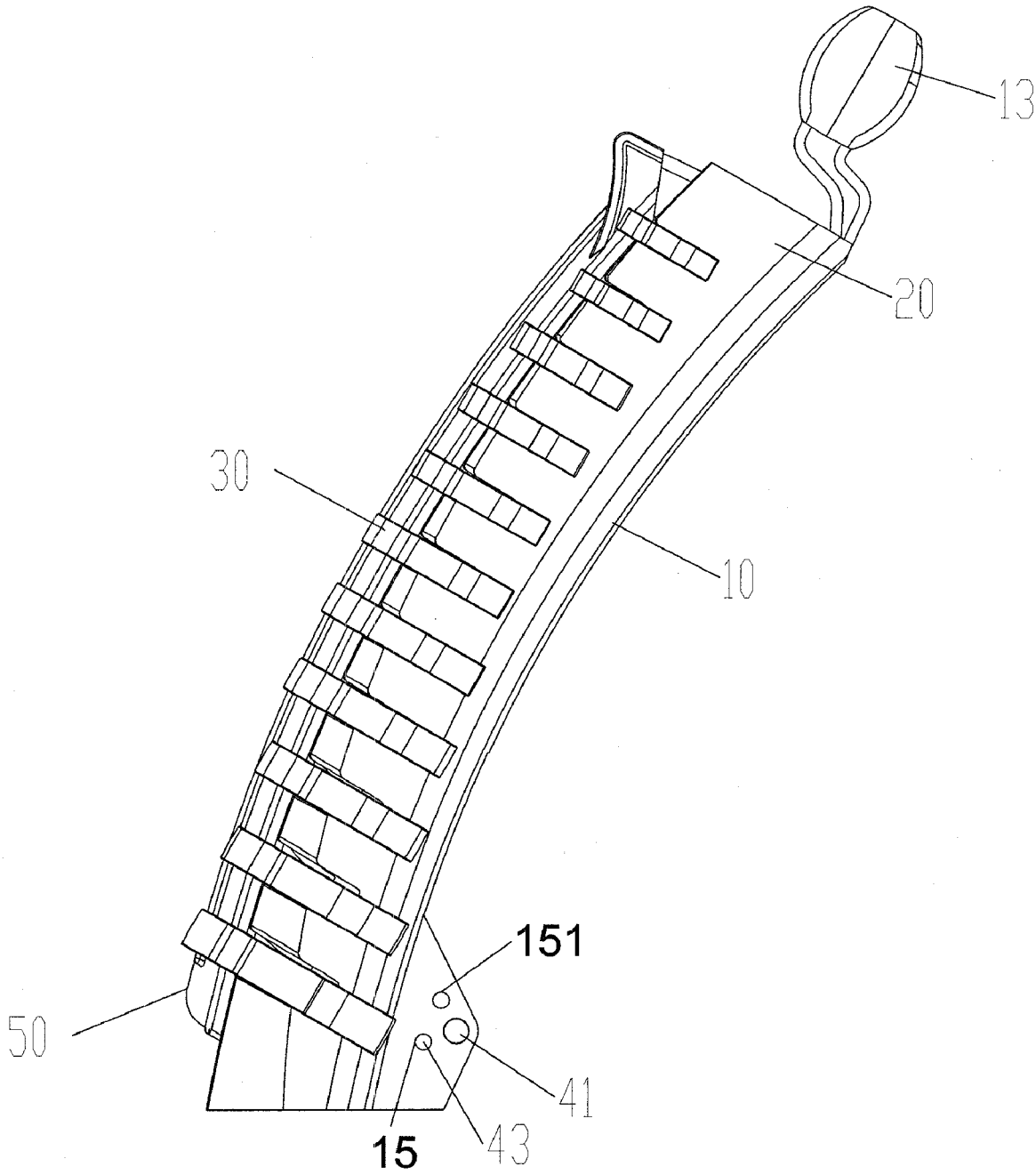
FIG. 5 is a side view of the wrench rack in accordance with the present invention.
Figure 7:
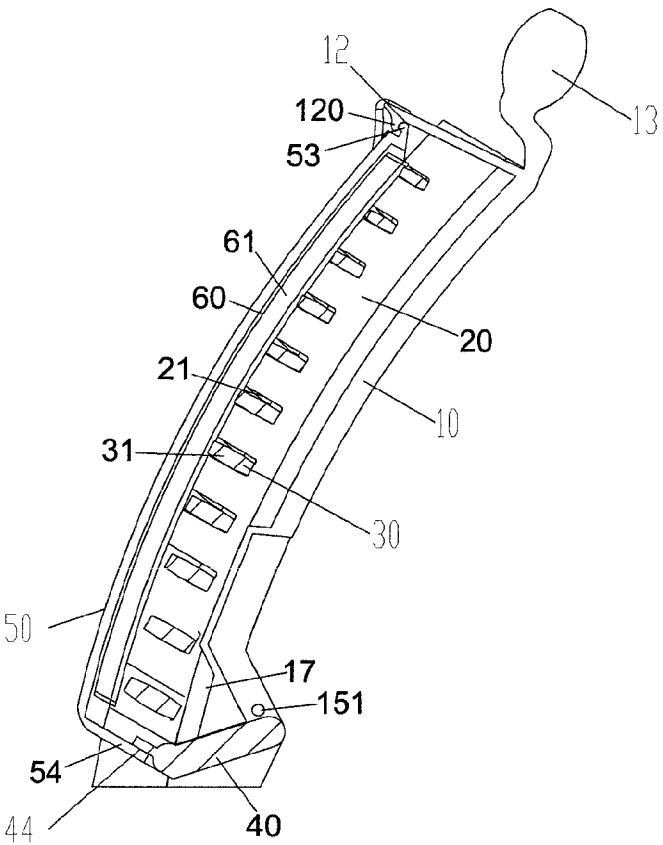
FIG. 7 is a cross-sectional view taken along plane A-A in FIG. 6.
Figure 6:
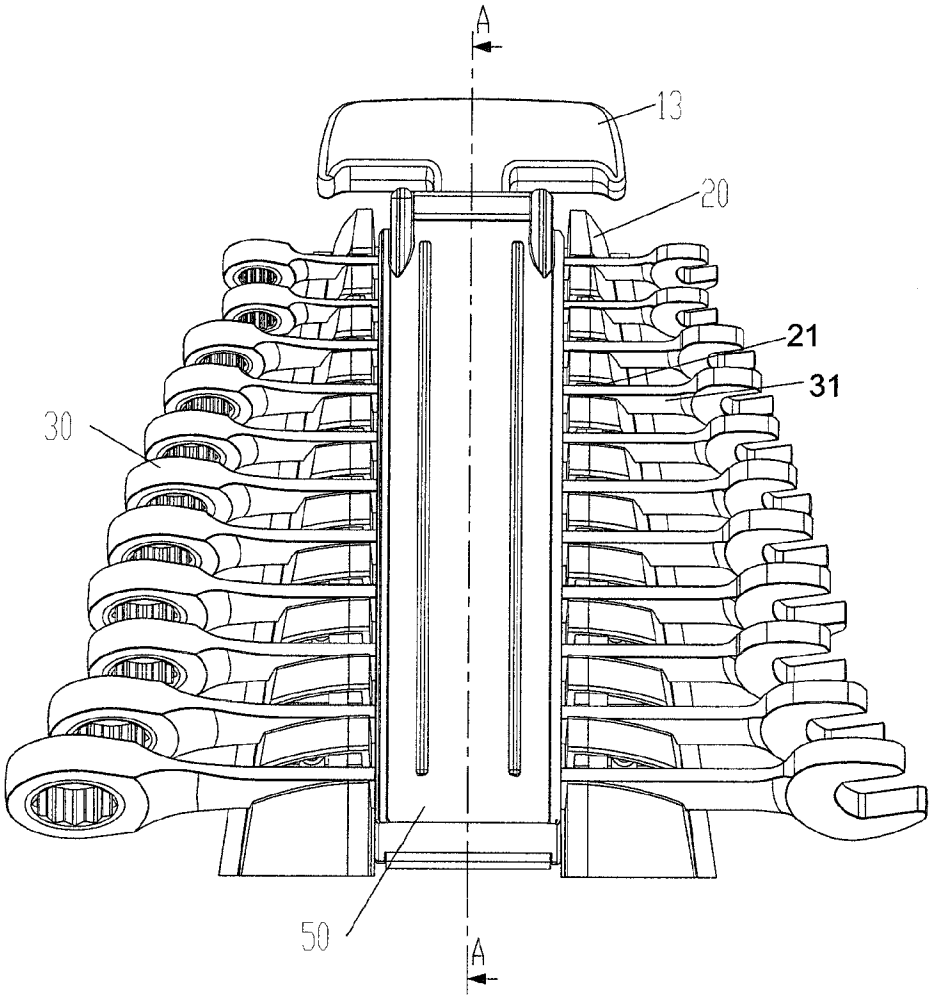
FIG. 6 is a front view of the wrench rack in accordance with the present invention.
Figure 8:
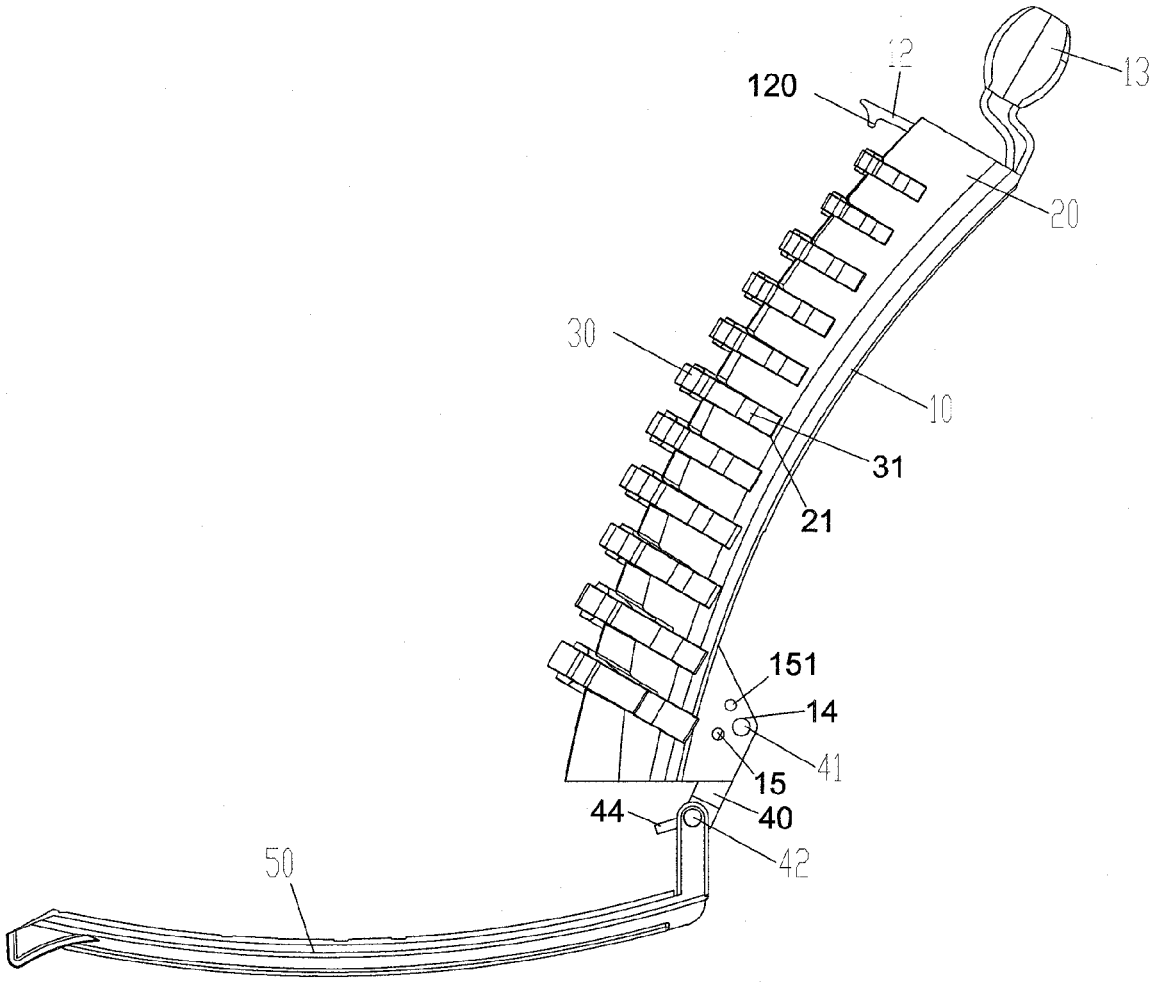
FIG. 8 is a side view of the cover plate revolving against the main frame to a certain angle in accordance with the present invention.

Referring to FIGS. 1 to 7, the standable wrench rack of the present invention comprises:

a main frame 10 having a hook plate 12 extended forwards and a hand grip 13 extended upwards at its top portion, the front end of the hook plate 12 having a hook 120 defined downwards, the bottom portion of the main frame 10 having at least a stand 18 laterally extended, a back plate 17 being extended downwards at the front center of the main frame 10 close to its bottom portion and a sunken anchor portion 16 being defined at the rear center of the main frame 10, a pivot 14, a first positioning hole 15 and a second positioning hole 151 also being defined at the bottom portion of the main frame 10, the first positioning hole 15 and the second positioning hole 151 respectively having equal distance relative to the pivot 14 which is an aperture shown in the drawings, and the second positioning hole 151 being deeper than the first positioning hole 15;

two recess bases 20, each recess base 20 being set on the main frame 10 and a plurality of crosscut recesses 21 being arranged on the front of the recess base 20, and a pair of corresponding recesses 21 on the two recess bases 20 allowing the handle portion 31 of a wrench 30 to be engaged;

a linkage member 40 having a first end and a second end opposite to each other, the first end having a protruded plate 44 and the second end linking with the pivot 14 of the main frame 10, at least one side of the linkage member 40 having a flange 43 which is designed corresponding to the first positioning hole 15 and the second positioning hole 151 and is able to be optionally lodged in the first positioning hole 15 or the second positioning hole 151, and the second end of the linkage member 40 having a first protruded shaft 41 to lodge in the pivot 14 as shown in the drawings; and a cover plate 50 having a buckle 53 defined on its top portion for the hook 120 of the hook plate 12 to clasp, its bottom portion linking with the first end of the linkage member 40, a pivot hole 51 also being defined at the bottom portion of the cover plate 50 shown in the drawings, the first end of the linkage member 40 having a second protruded shaft 42 to lodge in the pivot hole 51, at least a long groove 52 penetrating trough the cover plate 50, and an anchor plate 54 being laterally extended at the rear bottom portion of the cover plate 50.

Figure 9:
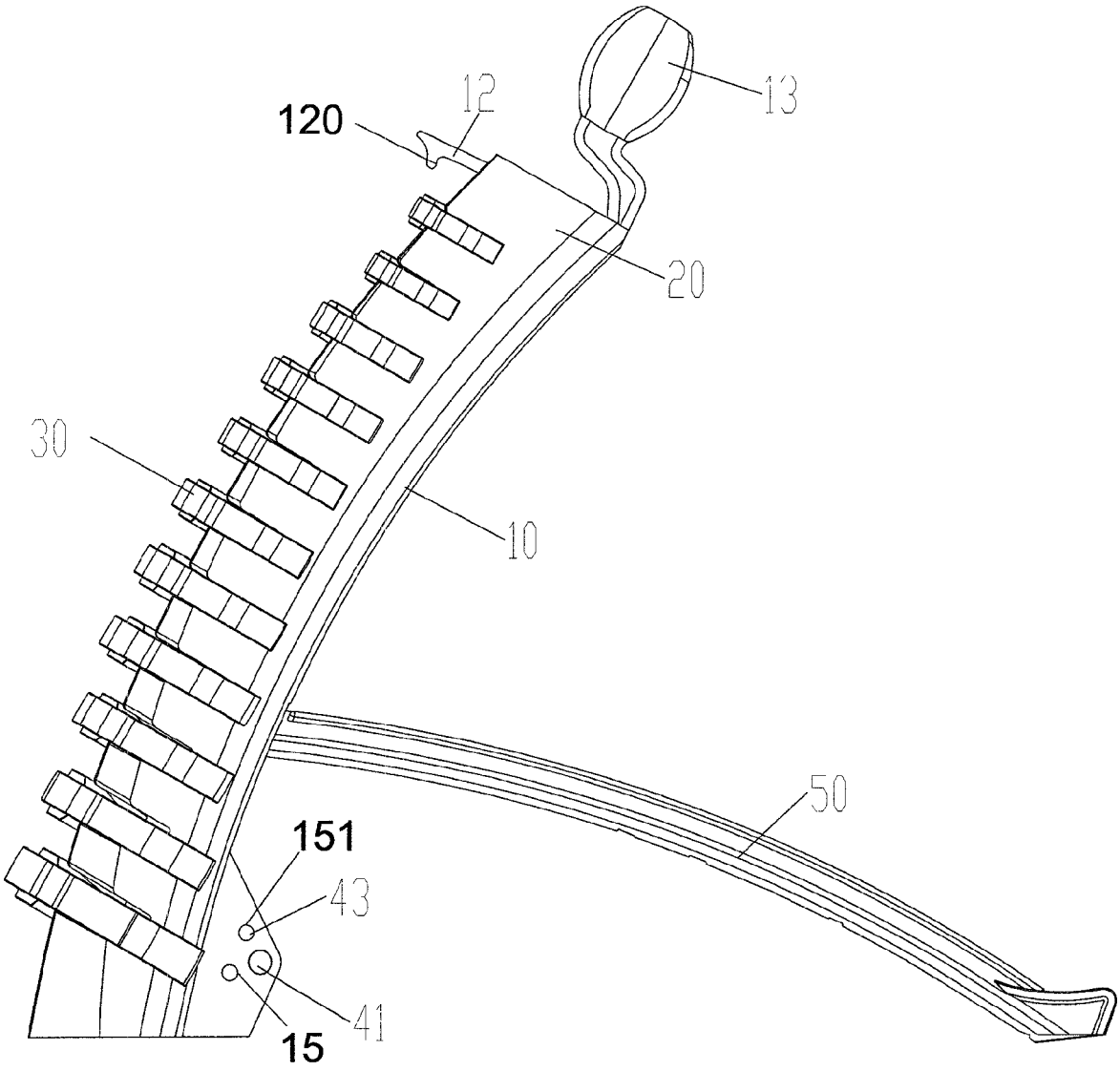
FIG. 9 is a side view of the standing main frame sustained by the cover plate in accordance with the present invention.
Figure 10:
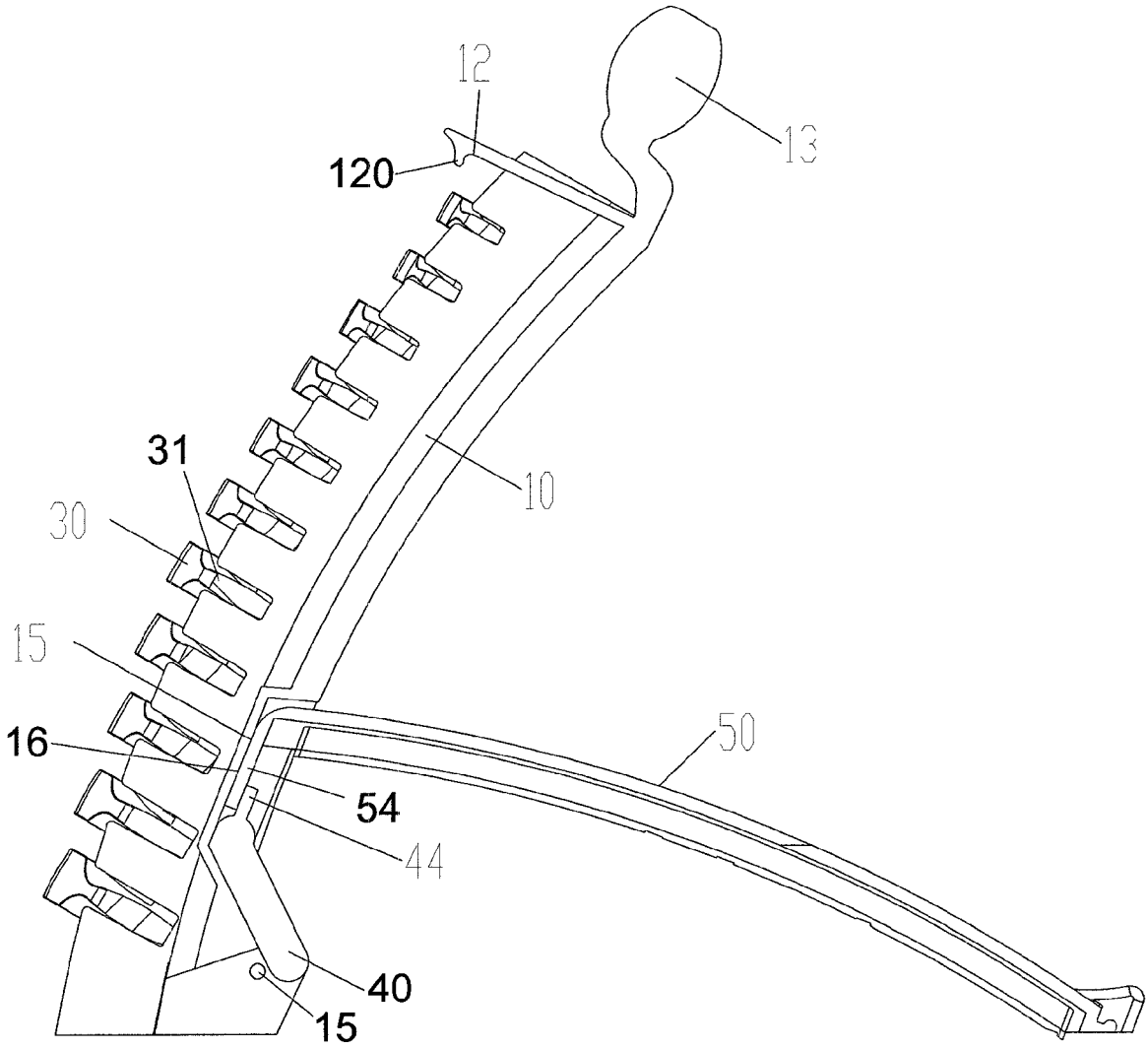
FIG. 10 is a cross-sectional view of the standing main frame sustained by the cover plate in accordance with the present invention.
Figure 11:
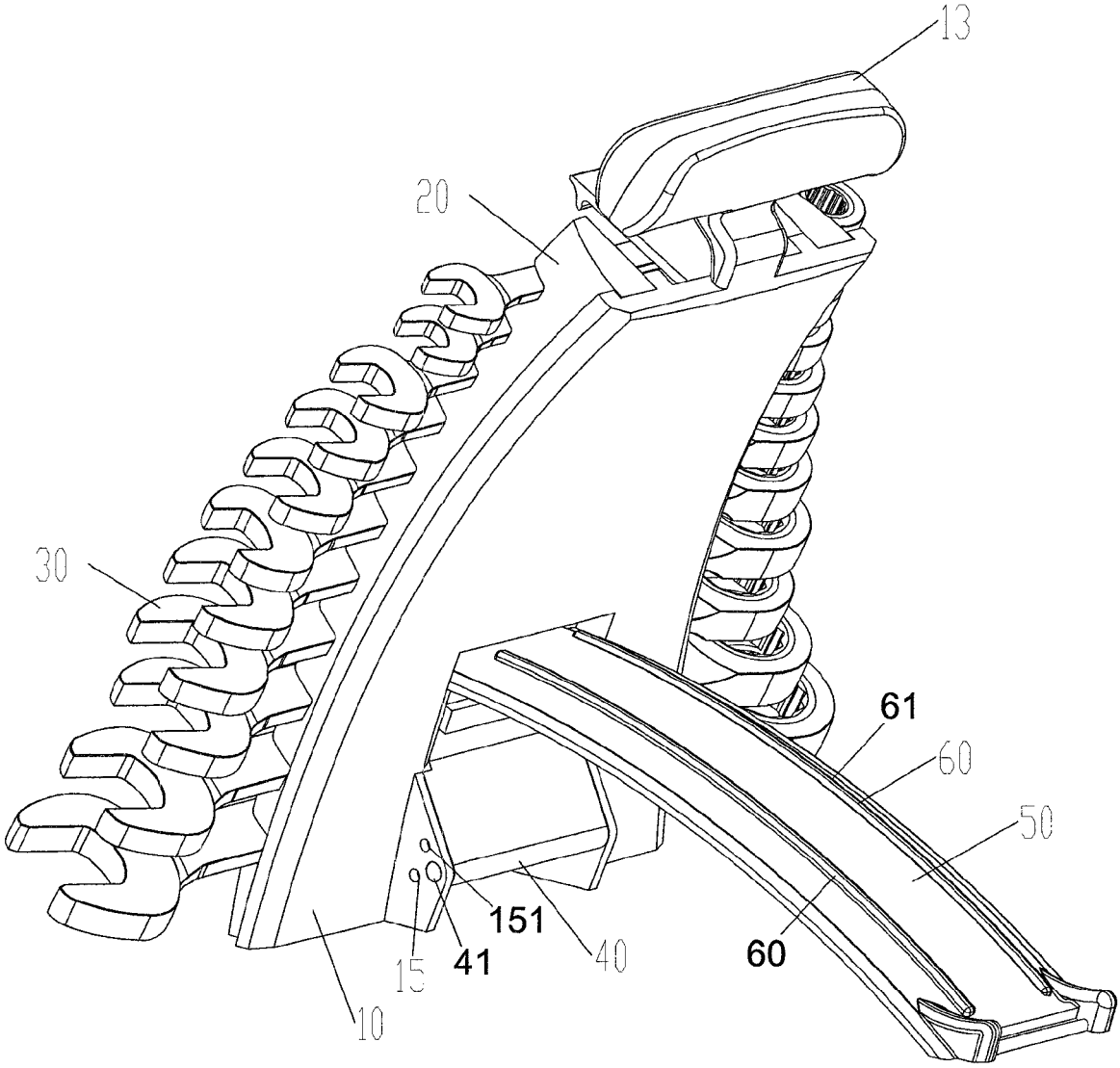
FIG. 11 is a perspective rear view of the standing main frame sustained by the cover plate in accordance with the present invention.

Referring to FIGS. 1 to 11, the embodiments of the present invention are stated as below. Shown in FIGS. 3 to 7, when the cover plate 50, relative to the main frame 10, is located at the first position where the cover plate 50 covers up the front of the main frame 10, the bottom portion of the back plate 17 props up the middle portion of the linkage member 40 for the flange 43 to lodge in the first positioning hole 15. When the buckle 53 of the cover plate 50 is released from the hook 120 of the hook plate 12, the cover plate 50 is capable of revolving against the main frame 10. When the flange 43 of the linkage member 40 is released from the first positioning hole 15, the cover plate 50 is capable of revolving against the main frame 10 along with the linkage member 40 shown as FIG. 8. When the cover plate 50 revolves against the main frame 10 to the second position where the cover plate 50 is flipped to the rear of the main frame 10, the flange 43 of the linkage member 40 is lodged into the second positioning hole 151. Inasmuch as one side of the anchor plate 54 of the cover plate 50 presses against the anchor portion 16 of the main frame 10 and the other side bears pressure from the protruded plate 44 of the linkage member 40, the cover plate 50 is able to extend with an inclination against the main frame 10 and its top portion is able to sustain the main frame 10 along with the stand 18 as shown in FIGS. 9 to 11.

Figure 12:
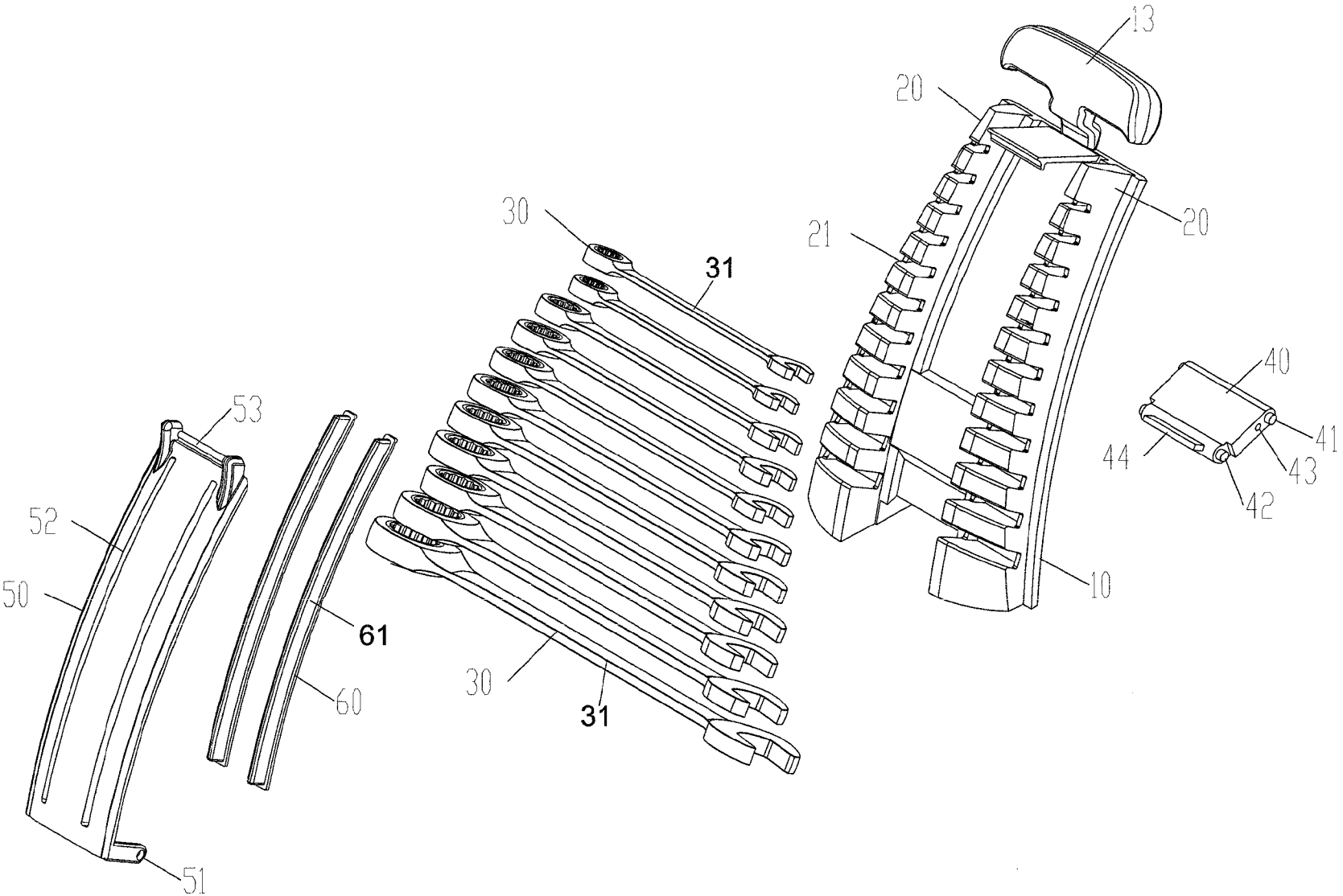
FIG. 12 is an exploded perspective view of the integrated recess bases and the main frame of the embodiment in accordance with the present invention.

Shown in FIG. 1, in one of the embodiments of the present invention, the main frame 10 and two recess bases 20 are separable. There is a plurality of first couplers 11 lined up close to two sides of the main frame 10 on the front respectively, and there is also a plurality of second couplers 22 defined on the rear of each recess base 20. The second couplers 22 and the first couplers 11 are coupled respectively for the two recess bases 20 to joint with the main frame 10. In the present embodiment, the first couplers 11 are tubular and the second couplers 22 are columnar, so they can be paired to joint together. Shown in FIG. 12, in another embodiment of the present invention, the main frame 10 and two recess bases 20 are integrated as one piece work.

Shown in FIG. 1, there is at least a long groove 52 penetrating through the cover plate 50. The hollow portion of the long groove 52 allows a resilient holding strip 60 to lodge in, and the holding strip 60 is partially stuck out of the long groove 52. When the cover plate 50 covers up the front of the main frame 10, the holding strip 60 is able to press the handle portion 31 of the wrench 30 and to steadily hold the wrench 30. In addition, the cover plate 50 is able to avoid damage from hitting by the wrench 30. At one side of the holding strip 60 is a protruded strip 61 with a smaller outer periphery to lodge in the hollow portion of the long groove 52 on the cover plate 50. As shown in FIG. 1, the quantity of the long groove 52 is two. Each long groove 52 allows a holding strip 60 to lodge in. With two holding strips 60 to press on the handle portion 30, the wrench 30 can be held much steadier.

Advantages of the present invention can be summarized as bellow.

1. The wrench 30 is embraced by two recess bases 20 and the cover plate 50, so the wrench 30 can be held much steadier on the holder.

2. The cover plate 50 is able to be flipped to the rear of the main frame 10 and to extend with an inclination against the main frame 10 for the main frame 10 to stand upright, so it is more convenient for users to choose a proper wrench with better viewing angle.

3. The anchor plate 54 of the cover plate 50 is lodged in the sunken anchor portion 16 and is fixed by the anchor portion 16 and the protruded plate 44 of the linkage member 40, so the main frame 10 is able to stand steadier.

4. The two recess bases 20 and the main frame 10 are designed to be separable, so the recess base 20 can be replaced with different sizes of recesses to hold different wrenches according to their sizes. Therefore, the use of the wrench rack is more flexible.

While we have shown and described the embodiment in accordance with the present invention, it should be clear to those skilled in the art that further embodiments may be made without departing from the scope of the present invention.

What is claimed is:

1. A standable wrench rack comprising:

a main frame having a hook plate extended forwards at its top portion and the front end of the hook plate having a hook, the bottom portion of the main frame having at least a stand laterally extended, a back plate being extended downwards at the front center of the main frame close to its bottom portion and a sunken anchor portion being defined at the rear center of the main frame; a pivot, a first positioning hole and a second positioning hole being defined at the bottom portion of the main frame, and the first positioning hole and the second positioning hole respectively having equal distance relative to the pivot;

two recess bases, each recess base being set on the main frame and a plurality of crosscut recesses being arranged on the front of the recess base, and a pair of corresponding recesses on the two recess bases allowing the handle portion of a wrench to be engaged;

a linkage member having a first end and a second end opposite to each other, the first end having a protruded plate and the second end linking with the pivot of the main frame, and at least one side of the linkage member having a flange which is designed corresponding to the first positioning hole and the second positioning hole; and a cover plate having a buckle defined on its top portion for the hook of the hook plate to clasp, its bottom portion linking with the first end of the linkage member, at least a long groove penetrating trough the cover plate, and an anchor plate being laterally extended at the rear bottom portion of the cover plate;

the bottom portion of the back plate propping up the middle portion of the linkage member for the flange to lodge in the first positioning hole as the cover plate covering up the front of the main frame; the cover plate being capable of revolving against the main frame as the buckle of the cover plate being released from the hook of the hook plate; the cover plate being capable of revolving against the main frame along with the linkage member as the flange of the linkage member being released from the first positioning hole; the flange of the linkage member being lodged into the second positioning hole as the cover plate revolving to the rear of the main frame; and inasmuch as one side the anchor plate of the cover plate pressing against the anchor portion of the main frame and the other side taking pressure from the protruded plate of the linkage member, the top portion of the cover plate being able to sustain the main frame along with the stand.

2. The wrench rack as claimed in claim 1, wherein the main frame and two recess bases are integrated as one piece work.

3. The wrench rack as claimed in claim 1, wherein there is a plurality of first couplers lined up close to two sides of the main frame on the front respectively, there is also a plurality of second couplers defined on the rear of each recess base, and the second couplers and the first couplers are coupled respectively for the two recess bases to joint with the main frame.

4. The wrench rack as claimed in claim 1, wherein there is at least a long groove penetrating through the cover plate, the hollow portion of the long groove allows a resilient holding strip to lodge in, and the holding strip is partially stuck out of the long groove.

5. The wrench rack as claimed in claim 4, wherein at one side of the holding strip is a protruded strip with a smaller outer periphery to lodge in the hollow portion of the long groove.

6. The wrench rack as claimed in claim 1, wherein the quantity of the long groove is two and each long groove allows a holding strip to lodge in.

7. The wrench rack as claimed in claim 1, wherein a hand grip is extended upwards at the top portion of the main frame.

* * * * *